313-414 SR
4/30/85 XR 4,514,659

United States Patent [19]
Chen

[11] Patent Number: 4,514,659
[45] Date of Patent: Apr. 30, 1985

[54] INLINE ELECTRON GUN FOR HIGH RESOLUTION COLOR DISPLAY TUBE

[75] Inventor: Hsing-Yao Chen, Landisville, Pa.

[73] Assignee: RCA Corporation, Princeton, N.J.

[21] Appl. No.: 354,655

[22] Filed: Mar. 4, 1982

[51] Int. Cl.[3] ..... H01J 29/50; H01J 29/56
[52] U.S. Cl. ..... 313/412; 313/414; 313/449
[58] Field of Search ..... 313/409, 414, 449, 446, 313/458, 447, 448, 412

[56] References Cited

U.S. PATENT DOCUMENTS

| | | | |
|---|---|---|---|
| 3,755,703 | 8/1973 | Ueno et al. | 313/409 |
| 3,772,554 | 11/1973 | Hughes | 313/69 |
| 3,852,608 | 12/1974 | Johanns et al. | 313/449 |
| 3,919,583 | 11/1975 | Hasker et al. | 313/448 |
| 4,095,144 | 6/1978 | Mendelsohn | 313/470 X |
| 4,143,293 | 3/1979 | Hosokoshi et al. | 313/409 |
| 4,234,814 | 11/1980 | Chen et al. | 313/414 X |
| 4,251,747 | 2/1981 | Burdick | 313/414 X |
| 4,287,450 | 9/1981 | Kawakami et al. | 313/449 X |
| 4,318,027 | 3/1982 | Hughes et al. | 313/449 X |
| 4,319,163 | 3/1982 | Chen | 313/414 X |
| 4,350,923 | 9/1982 | Hughes | 313/414 |

OTHER PUBLICATIONS

A High Performance Color CRT Gun with an Asymmetrical Beam Forming Region by Chen & Hughes, ST-5105 1980 IEEE Chicago Spring Conference on Consumer Electronics, Chicago, IL.

*Primary Examiner*—Palmer Demeo
*Assistant Examiner*—K. Wieder
*Attorney, Agent, or Firm*—Eugene M. Whitacre; Dennis H. Irlbeck

[57] ABSTRACT

An electron gun for a high resolution color display tube comprises three inline cathode assemblies, a control grid with three inline apertures, a screen grid with three inline apertures and slots at each aperture on a side facing away from the control grid, a first focusing electrode having three inline apertures facing the screen grid and three inline apertures facing away from the screen grid, and a second focusing electrode having three inline apertures facing the first focusing electrode. The diameters of the control grid apertures are in the range of 0.43 mm to 0.59 mm. The screen grid is spaced 0.13 mm to 0.26 mm from the control grid. The diameters of the screen grid apertures are in the range of 0.43 mm to 0.59 mm, and their thickness is in the range of 0.20 mm to 0.31 mm. The ratio of the depth of the slots in the screen grid to their widths is in the range of 0.13 to 0.23. The diameters of the apertures in the facing portions of both focusing electrodes are in the range of 4.06 mm to 5.44 mm, and the length of the first focusing electrode is in the range of 17.6 mm to 23.5 mm.

4 Claims, 2 Drawing Figures

INLINE ELECTRON GUN FOR HIGH RESOLUTION COLOR DISPLAY TUBE

This invention relates to electron guns for use in cathode ray tubes, and particularly to an optimized inline electron gun for use in high resolution color display tubes.

BACKGROUND OF THE INVENTION

Over the past several years, the catode ray tube has evolved as an important means for displaying information in computer terminals. This is because the cathode ray tube is well developed, cost effective device with fast writing and erasing speeds. Most display tubes have been of the monochrome type; however, recent needs have been for high resolution color displays in order to properly present the increasingly sophisticated and complex information generated by computers. Most of the commercially sold high resolution color display tubes have used delta electron gun and dot screen systems. When properly set up, such tubes have very good center and corner resolutions and good electron beam convergence. However, it is known that the convention circuitry required for a delta electron gun is not only costly, but also subject to drifts. Since display tubes are usually viewed at closed range, such convergence drifts are very undesirable.

It has been determined that a self-converged system using an inline electron gun, such as that disclosed in U.S. Pat. No. 3,772,554 issued to R. H. Hughes on Nov. 13, 1973, a self-converging yoke, and a dot screen provides improved display tube performance because of the elimination of convergence drift. However, the performance of the electron beam spot at the corners of the display tube tends to suffer because of the self-converging yoke. Since the corners are just as important as the center of the tube when displaying characters theron, there is need to improve display tubes and especially the inline electron guns therefor to improve performance at the corners of the tubes.

SUMMARY OF THE INVENTION

An electron gun for a high resolution color display tube comprises three inline cathode assemblies, a control grid with three inline apertures, a screen grid with three inline apertures and slots at each aperture on a side facing away from the control grid, a first focusing electrode having three inline apertures facing the screen grid and three inline apertures facing away from the screen grid, and a second focusing electrode having three inline apertures facing the first focusing electrode. The diameters of the control grid apertures are in the range of 0.43 mm to 0.59 mm. The screen grid is spaced 0.13 mm to 0.26 mm from the control grid. The diameters of the screen grid apertures are in the range of 0.43 mm to 0.59 mm, and their thickness is in the range of 0.20 mm to 0.31 mm. The ratio of the depth to the width of the slots in the screen grid is in the range of 0.13 to 0.23. The diameters of the apertures in the facing portions of both focusing electrodes are in the range of 4.06 mm to 5.44 mm, and the length of the first focusing electrode is in the range of 17.6 mm to 23.5 mm.

DETAILED DESCRIPTION

Figure 1:
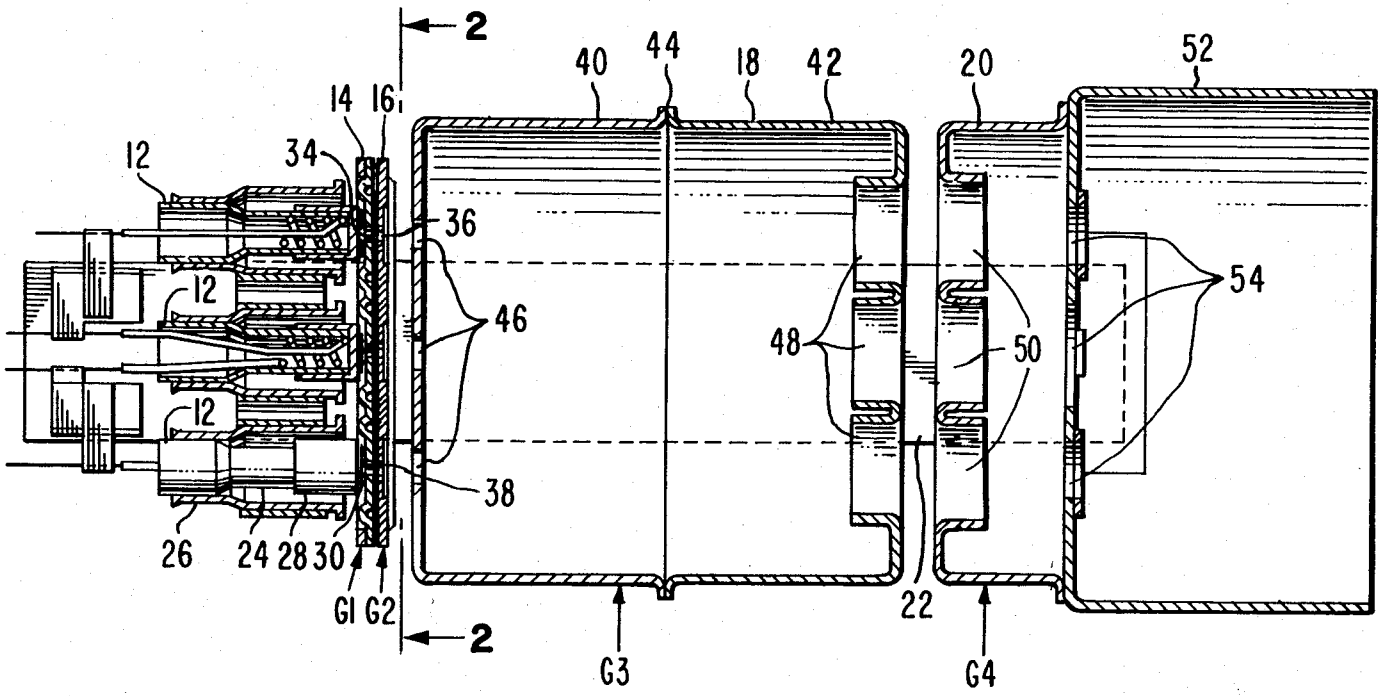
FIG. 1 is a longitudinal section of a novel inline electron gun embodying the present invention.
Figure 2:
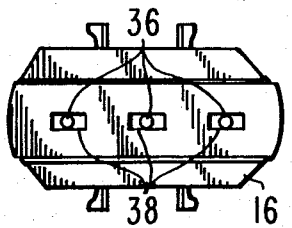
FIG. 2 is a plan view of a screen grid taken at line 2—2 of FIG. 1.

FIG. 1 illustrates an electron gun 10 comprising three inline cathode assemblies 12, a control grid (G1) 14, a screen grid (G2) 16, a first focusing electrode (G3) 18, and a second focusing electrode (G4) 20, all mounted in spaces relationship on a pair of insulator support rods 22 (only one shown). Each cathode assembly 12 includes a tubular sleeve 24 attached to an eyelet 26, which in turn is interconnected to the support rods 22. An end of the tubular sleeve 24, facing the control grid 14, is closed with a cap 28 which includes an electron emissive material 30 on the outside of its closed end. A heater coil 32 is positioned within each sleeve 24. The control grid 14 is located adjacent to and spaced from the cathode assemblies 12. The control grid 14 includes three inline apertures 34 which are aligned with the centers of the emissive materials 30 on the cathode assemblies 12. The screen grid 16 is located adjacent to and spaced from the control grid 14. The screen grid 16 incudes three inline apertures 36 which are aligned with the three apertures 34 of the control grid 14. As shown in FIG. 2, the screen grid 16 also includes three slots 38 located at the apertures 36 on the side of the screen grid 16 facing away from the control grid 14. The slots 38 extend lengthwise in the inline direction of the inline apertures 36.

The first focusing electrode 18 comprises a pair of cup-shaped cups 40 and 42 joined together at their open ends 44. The cup 40 includes three inline apertures 46 in its bottom through which electron beams enter the first focusing electrode 18. The cup 42 includes three larger inline apertures 48 in its bottom through which the electron beams exit from the first focusing electrode 18. The second focusing electrode 20 also is cup-shaped, having three large inline apertures 50 in its bottom. The two outer apertures 50 in the second focusing electrode 20 may be offset slightly outward from the two outer aperatures 48 in the first focusing electrode 18 to cause the two outer electron beams to converge toward the center electron beam. The open end of the second focusing electrode is closed by a shield cup 52 which contains three inline apertures 54 in its bottom.

The electron gun 10 is generally optimized for low electron beam current (200 $\mu$A) operation when the dimentional constraints presented in TABLE I are met.

TABLE I

| | |
|---|---|
| Diameter of control grid apertures 34 | 0.43 mm to 0.59 mm |
| Control grid to screen grid spacing | 0.13 mm to 0.26 mm |
| Screen grid thickness at aperture | 0.20 mm to 0.31 mm |
| Diameter of screen grid apertures 36 | 0.43 mm to 0.59 mm |
| Ratio of screen grid slot depth to slot width | 0.13 to 0.23 |
| Diameter of facing apertures in the first and second focusing electrodes 48, 50 | 4.06 mm to 5.44 mm |
| Length of first focusing electrode | 17.6 mm to 23.5 mm |

One preferred embodiment of the electron gun 10 is particularly optimized when the approximate dimensional constraints presented in TABLE II are met.

TABLE II

| | |
|---|---|
| Diameter of control grid apertures 34 | 0.53 mm |
| Control grid to screen grid spacing | 0.13 mm |
| Screen grid thickness at aperture | 0.20 mm |
| Diameter of screen grid apertures 36 | 0.53 mm |
| Ratio of screen grid slot depth to slot width | 0.21 |
| Diameter of facing apertures in the first and second focusing electrodes 48, 50 | 5.4 mm |
| Length of first focusing electrode. | 23.5 mm |

GENERAL CONSIDERATIONS

It is known that a lower electron beam current is required for color display tubes than for commercial color picture tubes. Commercial color picture tubes are generally operated at a peak electron beam current of 3.5 mA to 4.0 mA. Most color display tube operate at an electron beam current of less than 150 $\mu$A. The preferred electron gun described herein is designed to obtain optimum tube performance at a peak electron beam current of approximately 200 $\mu$A. In this low current application, the magnification factor of the electrostatic focus lens formed between the first and second focusing electrodes becomes the dominant factor in determining electron beam spot size at the tube screen. It has been found that a gun having only two focusing electrodes, rather than three or more electrodes, is inherently better because of its longer object distance. In the electron gun 10, the focus voltage applied to the first focusing electrode 18 is appoximately 28 percent of the anode voltage applied to the second focusing electrode 20. This, combined with the sizes of the apertures in the focusing electrodes and with the long first focusing electrode, provides the desired magnification to obtain a preferred spot size at the tube screen.

In the electron gun 10, the cathode assemblies, the control grid, and the screen grid comprise what is commonly referred to as the beam forming region of the gun. It is known that the thickness of the screen grid can be used as an effective means to control electron beam divergence angle in an electron gun. The thickness of the screen grid 16 is selected to match the beam forming region with the main focus lens of the gun, formed by the first and second focusing electrodes, for the 200 $\mu$A peak current performance. Furthermore, the size of the apertures in the control grid were chosen as a compromise between cathode life and small object imaging. Cathode life decreases with decreasing size of the control grid aperture, since the electrons are emitted from a smaller area of the emissive material on the cathode.

As noted above, the performance at the corners of a display tube is just as important as the performance at the center of the tube. In prior inline gun and self-converging yoke systems, the resolution in the corners of the tube is worse than at the center of the tube. To narrow this disparity and to trade the screen grid voltage and the control grid-to-screen grid spacing in reasonable ranges for production purposes, the horizontal slots 38 are added to the first focusing electrode side of the screen grid. The slot strength or effect of the slot is related to the ratio of the slot depth to the slot width. The slots create a quadrupole lens effect in the electrostatic fields, which narrows, i.e., vertically elongates, the electron beams. This results in minimization of the corner beam spot size and improves the readibility of the displayed information at the corners.

Beacause of high information content requirements, display tubes require much wider video drive bandwidths than do commercial color picture tubes. In general, the bandwidth circuits are limited by the drive voltage range, which usually is about 40 to 45 volts. In order to accommodate this practical drive limitation, the display tube 10 is optimized at 100 voltage cutoff. At this cutoff voltage, the center and corner electron beam spot sizes are most nearly equal.

What is claimed is:

1. An inline electron gun for producing three inline electron beams each having an electron beam current of approximately 200 microamps for use in a high resolution color display tube, comprising three inline cathode assemblies, a control grid adjacent to said cathode assemblies, said conrol grid including three inline apertures aligned with said cathode assemblies, the diameters of the control grid apertures being in the range of 0.43 mm to 0.59 mm, a screen grid spaced from 0.13 mm to 0.26 mm from said control grid, said screen grid including three inline apertures aligned with the control grid apertures, the diameters of the control grid apertures being in the range of 0.43 mm to 0.56 mm, the thickness of said screen grid at the aperatures being in the range of 0.20 mm to 0.31 mm, said screen grid including a slot at each screen grid aperture longitudinally extending in the inline direction of the three inline screen grid apertures, each slot being on a side of the screen grid facing away from the control grid, the ratio of the depth of the slot to the width of the slot being in the range of 0.13 to 0.23, a first focusing electrode adjacent to an spaced from said screen grid, said first focusing electrode including three inline apertures fcing said screen grid and three inline apertures facing away from said screen grid, the diameters of the first focusing electrode aperatures facing away from said screen grid being in the range of 4.06 mm to 5.44 mm, the length of said first focusing electrode being in the range of 17.6 mm to 23.5 mm, and a second focusing electrode adjcent to and spaced from said first focusing electrode, said second focusing electrode including three inline apertures facing said first focusing electrode, the diameter of the second focusing electrode apertures being in the range of 4.06 mm to 5.44 mm.

2. The gun as defined in claim 1 wherein the diameters of the control grid apertures are appoximately 0.53 mm, the control grid-to-screen grid spacing in approximately 0.25 mm, the screen grid thickness at the apertures is approximately 0.20 mm, the diameters of the screen grid apertures are approximately 0.53 mm, the length of said first focusing electrode is approximately 23.5 mm, the ratio of slot depth to slot width in the screen grid is approximately 0.21 and the diameters of the first focusing electrode pertures facing away from the screen grid and the diameters of the second focusing electrode facing the first focusing electrode are approximately 5.4 mm.

3. The gun as defined in claims 1 or 2 including a voltge applied to said first focusing electrode which is approximately 28 percent of the voltage applied to said second focusing electrode.

4. The gun as defined in claims 1 or 2 wherein the cutoff voltage for said gun is approximately 100 volts.

* * * * *